US008382252B2

(12) United States Patent
Yamada et al.

(10) Patent No.: US 8,382,252 B2
(45) **Date of Patent: *Feb. 26, 2013**

(54) LIQUID EJECTING APPARATUS WITH AN ELECTRIC POTENTIAL CONTROL UNIT

(75) Inventors: Yoichi Yamada, Shiojiri (JP); Kiyoteru Katsuki, Azumino (JP); Masaru Kobashi, Matsumoto (JP); Daisuke Matsumoto, Matsumoto (JP); Yasunori Koike, Matsumoto (JP); Narihiro Oki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 142 days.

This patent is subject to a terminal disclaimer.

(21) Appl. No.: 12/914,351

(22) Filed: Oct. 28, 2010

(65) Prior Publication Data

US 2011/0102513 A1 May 5, 2011

(30) Foreign Application Priority Data

Oct. 29, 2009 (JP) ..... 2009-249174
Apr. 28, 2010 (JP) ..... 2010-103869

(51) Int. Cl.
*B41J 2/06* (2006.01)

(52) U.S. Cl. ..... 347/55; 347/54

(58) Field of Classification Search ..... 347/5, 9, 347/10, 13, 14, 16, 40, 42, 54, 55, 101, 104, 347/105

See application file for complete search history.

(56) References Cited

U.S. PATENT DOCUMENTS

| | | | | |
|---|---|---|---|---|
| 5,298,926 | A * | 3/1994 | Fukushima et al. | 347/34 |
| 6,097,408 | A | 8/2000 | Fukushima et al. | |
| 6,508,540 | B1 | 1/2003 | Lean et al. | |
| 2007/0091146 | A1 | 4/2007 | Endo et al. | |
| 2011/0102490 | A1 * | 5/2011 | Yamada et al. | 347/16 |
| 2011/0102507 | A1 | 5/2011 | Yamada et al. | |

FOREIGN PATENT DOCUMENTS

| | | |
|---|---|---|
| JP | 2003-165230 | 6/2003 |
| JP | 2007-118318 | 5/2007 |
| JP | 2007-118320 | 5/2007 |
| JP | 2007-118321 | 5/2007 |
| JP | 2008-213255 | 9/2008 |

* cited by examiner

*Primary Examiner* — Juanita D Jackson
(74) *Attorney, Agent, or Firm* — Workman Nydegger

(57) ABSTRACT

A liquid ejecting apparatus, including an electric potential control unit capable of switching between an identical electric potential state which sets a predetermined region of the liquid ejection unit side and a predetermined region of the ejecting medium support unit side to the identical electric potential and an electric potential difference generating state which generates the electric potential difference between both of them, wherein the liquid ejecting apparatus includes a configuration in which, when the ejecting medium passes through a liquid ejecting area to which the liquid is ejected by the liquid ejection unit, the electric potential control unit forms the identical electric potential state, and when the ejecting medium does not pass through the liquid ejecting area, the electric potential control unit forms the electric potential difference generating state for at least a proper period.

7 Claims, 13 Drawing Sheets

LIQUID EJECTING APPARATUS WITH AN ELECTRIC POTENTIAL CONTROL UNIT

BACKGROUND

1. Technical Field

The present invention relates to a liquid ejecting apparatus represented by a facsimile or a printer.

2. Related Art

Hereinafter, an inkjet printer as an example of the liquid ejecting apparatus will be described. The ink jet printer is configured so as to have a support member (also called a platen) at a position facing an ink jet recording head, thereby defining the distance between the ink jet recording head and a recording paper, by supporting the recording paper by the support member.

Herein, in the ink jet printer of recent years, as miniaturization of ink droplets proceeds aiming for further improvements in recording quality, ink droplets become further miniaturized, for example, to the extent of several pl. For this reason, the mass of the ink droplet is extremely small, and even if the ink droplet is discharged from the ink jet recording head to the recording paper, a part thereof does not impact on the recording paper, becomes mist and floats, generating various problems. In addition, in a so-called edgeless recording which performs the recording without a margin at four sides of the recording paper, since the ink droplet is discharged even at an area deviated from the end portions of the recording paper, the mist and floating phenomenon becomes more noticeable.

Thus, hitherto, as described in JP-A-2007-118321 and JP-A-2007-118318, there is proposed a technique in which Coulomb's force operates on the ink droplet, by providing an electric potential difference among the ink jet recording head, the recording paper, and the support member to generate an electric field, thereby attracting the ink droplet to the recording paper.

1. Problems Generated Due to High Speed Transportation of Recording Paper

Incidentally, in ink jet printers of recent years, there is suggested a stationary ink jet recording head that does not perform the scanning (movement), one that can perform the recording by an extremely high throughput using a so-called line head. In the ink jet printer, the recording paper is transported in a paper transport path inside the apparatus at the extremely high speed.

However, it was ascertained that the following problem is generated due to the high speed transportation of the recording paper. That is, paper powder generated during cutting attaches to the end portions (edges) of the recording paper, but in a case where the electric potential among the three elements (hereinafter, collectively called "recording portion constituents) of the recording paper, the support member (platen) and the ink jet recording head is not controlled, the paper powder attached to the recording paper flies toward the ink jet recording head and is attached thereto, due to the electric field generated among the recording portion constituents. Particularly, in case of transporting the recording paper at a high speed, the vibration or the impact increases during the paper transportation, with the result that the flying of the paper powder is more noticeably generated.

Furthermore, due to the friction between the recording papers accommodated in a paper cassette, or sliding contact and contact among the constituents (e.g., an edge guide, a transport roller or the like) of the paper transport path and the recording paper, frictional electrification or separation electrification is noticeable, that is, the recording portion constituents are more noticeably electrified. As a result, since the electric field formed among the recording portion constituents also becomes stronger and the electrification of the paper powder itself becomes stronger, the Coulomb's force added to the paper powder increases, whereby the attachment of the paper powder to the ink jet recording head is more noticeable.

Moreover, even when the paper powder themselves are not electrified, when the flying paper powder flies and is disposed in the electric field, bias of the electric charge is generated in the paper powder by a dielectric polarization or an electrostatic induction, with the result that the paper powder are attracted to the ink jet recording head side.

FIG. 13 is am explanation diagram for showing the problems, reference numeral 160 refers to an ink jet recording head, reference numeral 160*a* refers to a nozzle plate, reference numeral 170 refers to a support member (a platen), and reference numeral 170*a* refers to a rib formed on the support member 170. In addition, reference numeral P refers to recording paper, reference numeral Pe refers to a paper end portion, and reference numeral d refers to a paper powder. Furthermore, "+" and "−" surrounded by circles refer to electrification polarities.

The recording paper P is ionized by an ionizing brush or the like, thus, the paper powder d attached to the recording paper P is not electrified. However, as shown in an enlarged view of the paper powder d, in cases (an example) where a nozzle plate 160*a* is positively electrified and a support member 170 is negatively electrified, by dielectric polarization (when the paper powder d has a property of a dielectric) or the electrostatic induction (when the paper powder d has a property of a conductor), a negative electric charge appears on the nozzle plate side of the paper powder d and a positive electric charge appears on the support member side. In addition, the paper powder d can hereby be attracted to any side of the nozzle plate 160*a* and the support member 170.

In addition, when the paper powder is attached to the ink jet recording head, the paper powder directly blocks the nozzle opening, or the paper powder moves to the nozzle opening when cleaning (wiping) of the nozzle surface, which causes a dot omission.

Furthermore, besides the physical blockage of the nozzle opening by the paper powder, a filler such as calcium carbonate constituting the paper powder sometimes reacts with the moisture of ink and increases in viscosity, which hinders the vibration of the meniscus of a nozzle opening, thereby interfering with the discharging of the ink droplet. Thus, it is extremely important to prevent the attachment of the paper powder to the ink jet recording head, in order to obtain a suitable recording quality in the ink jet printer.

2. Problem of the Related Art

In JP-A-2007-118321 and JP-A-2007-118318, there is proposed a technique in which an electric potential difference among the ink jet recording head, the recording paper and the support member (recording portion constituents) is provided to generate the electric field, whereby Coulomb's force is acted on the ink droplet, thereby attracting the ink droplet to the recording paper, as described above. Thus, if the paper powder is regarded as lumped together with the ink droplet, it is considered that, by controlling the electric field to attract the paper powder to the recording paper side, attachment of the paper powder to the ink jet recording head can be prevented.

However, the cellulose fabric and the filler constituting the paper powder are easily electrified in any polarity of positive and negative in a triboelelctric series manner, and thus, even if it tries to prevent the flying of the paper powder to the ink jet recording head side by forming the electric field of a specific direction among the recording portion constituents, it is impossible to prevent the flying of the paper powder electrified to the opposite polarity to the ink jet recording head side.

Furthermore, in JP-A-2003-165230, there is described a recoding apparatus which is configured so as to provide an air duct around a nozzle plate to eject the humidified air from the air duct during recoding and during recoding standby, with a view to preventing the attachment of the paper powder, dust or the like to the vicinity of the nozzle portion of the ink jet recording head. However, in this configuration, there is a fear that the complexity of the configuration may cause the apparatus to become bigger and rise in cost, and the air flow may rather cause the paper powder to attach to the recording head.

Moreover, in JP-A-2008-213255, there is described a technique in which the paper powder is collected by a paper powder collection member including an electrification property. However, in this technique, the paper powder cannot necessarily be effectively collected because of the opposite polarity as described above, and the handling (removal) of the paper powder deposited on the paper powder collection member becomes a problem. Particularly, in the state in which a lot of the paper powder is deposited, there is a fear that the paper powder is scattered to the surroundings by slight vibrations or impact, whereby the maintenance of prolonged performance is a problem.

SUMMARY

3. Object to be Solved by the Invention

An advantage of some aspects of the invention is to reliably prevent foreign matter (hereinafter, referred to as "paper powder and the like") such as paper powder and dust from being attached to the ink jet recording head, without deteriorating the recoding quality.

According to a first aspect of the invention, a liquid ejecting apparatus, which includes a liquid ejection unit for ejecting liquid to an ejecting medium, and an ejecting medium support unit that is disposed opposite to the liquid ejection unit and supports the ejecting medium, includes an electric potential control unit capable of switching between an identical electric potential state which sets a predetermined region of the liquid ejection unit side and a predetermined region of the ejecting medium support unit side to the identical electric potential and an electric potential difference generating state which generates the electric potential difference between both of them, wherein the liquid ejecting apparatus includes a configuration in which, when the ejecting medium passes through a liquid ejecting area to which the liquid is ejected by the liquid ejection unit, the electric potential control unit forms the identical electric potential state, and when the ejecting medium does not pass through the liquid ejecting area, the electric potential control unit forms the electric potential difference generating state for at least a proper period.

According to the first aspect of the invention, when the ejecting medium passes through the liquid ejecting area to which the liquid is ejected by the liquid ejection unit, the predetermine region of the liquid ejection unit side and the predetermined region of the ejecting medium support unit side are set to the identical electric potential. Thus, a state, in which the electric field between the liquid ejection unit and the ejection medium support unit is extremely weak or the electric field is rarely formed, is generated (hereinafter, for convenience, this state is called non-electric field state).

That is, the ejection medium to which the paper powder and the like is attached is placed in the non-electric field area between the liquid ejection unit and the ejecting medium support unit, so that the paper powder and the like attached to the ejecting medium is suppressed from being scattered and flying, whereby almost all of the paper powder and the like is discharged to the outside of the apparatus together with the ejecting medium in the state of being attached to the ejecting medium. Thus, it is hereby possible to reliably prevent the flying and attachment of the paper powder and the like to the liquid ejection unit.

Moreover, when the ejecting medium does not pass through the liquid ejecting area, the electric potential control unit forms the electric potential difference generating state for at least a proper period. That is, since the electric field is formed, the liquid ejected from the liquid ejection unit can be attracted to the ejecting medium or the ejecting medium support unit, whereby it is possible to solve the problem caused by the fact that the liquid becomes mist and floats.

According to a second aspect of the invention, in the first aspect, the electric potential control unit sets the ejecting medium and the predetermined region of the liquid ejection unit side to the identical electric potential in the identical electric potential state.

According to the present aspect of the invention, since the portion between the ejecting medium and the liquid ejection unit becomes a non-electric field, the paper powder and the like attached to the ejecting medium is more reliably suppressed from flying toward the liquid ejection unit, whereby almost all of the paper powder and the like is discharged to the outside of the apparatus together with the ejecting medium in the state of being attached to the ejecting medium. Thus, this can more reliably prevent the attachment of the paper powder and the like to the liquid ejection unit.

According to a third aspect of the invention, in the first or second aspect, the electric potential control unit is switched from the electric potential generating state to the identical electric potential state before a front end of the ejecting medium enters the liquid ejecting area.

According to the present aspect, since the electric potential control unit is switched from the electric potential difference generating state to the identical electric potential state before the front end of the ejecting medium enters the liquid ejecting area, the front end of the ejecting medium where the attachment of the paper powder and the like is noticeable can be reliably placed in the non-electric field area, whereby it is possible to reliably prevent the flying and attachment of the paper powder and the like to the liquid ejection unit.

According to a fourth aspect of the invention, in any one of the first to third aspects, the electric potential control unit is switched from the identical electric potential state to the electric potential difference generating state after the rear end of the ejecting medium comes out of the liquid ejecting area.

According to the present aspect, since the electric potential control unit is switched from the identical electric potential state to the electric potential difference generating state after the rear end of the ejecting medium comes out of the liquid ejecting area, the rear end of the ejecting medium where the attachment of the paper powder and the like is noticeable is reliably placed in the non-electric field area, whereby it is possible to reliably prevent the flying and attachment of the paper powder and the like to the liquid ejection unit.

According to a fifth aspect of the invention, in any one of the first to fourth aspects, the electric potential control unit is configured so as to switch between the identical electric potential state and the electric potential difference generating state in an end portion area of the ejecting medium in a second direction perpendicular to a first direction which is a transport direction of the ejecting medium, whereby in an area except for the end portion area, the electric potential difference is formed between the liquid ejection unit and the ejecting medium support unit.

According to the present aspect, the end portion of the ejecting medium where the attachment of the paper powder and the like is noticeable is placed in the none electric field area, so that the paper powder and the like attached to the end portion of the ejecting medium is suppressed from being scattered and flying, whereby almost all of the paper powder and the like is discharged to the outside of the apparatus together with the ejecting medium in the state of being attached to the end portion of the ejecting medium. Thus, it is possible to reliably prevent the flying and attachment of the paper powder and the like to the liquid ejection unit.

In addition, since an area except for the end portion area of the ejecting medium is configured so that the electric potential difference is formed between the liquid ejection unit and the ejecting medium support unit, the electric field is formed in the area so that the liquid ejected from the liquid ejection unit and that can be attracted to the ejecting medium by Coulomb's force can be reliably impacted. Thus, it is possible to prevent a decline in the liquid ejection quality and to solve problems the due to the fact that the liquid becomes mist and floats.

According to a sixth aspect of the invention, in any one of the first to fifth aspects, the predetermined region of the liquid ejection unit side is a surface which faces the ejecting medium support unit, and the predetermined region of the ejecting medium support unit side is a surface which faces the liquid ejection unit.

According to the present aspect, in the liquid ejection unit side and the ejecting medium support unit side, since the predetermined regions (regions in which the electric potential is controlled) becoming the identical electric potential are the surfaces facing each other, the turning electric field from the surroundings can be suppressed, which makes it possible to more reliably place the paper powder and the like in the non-electric field state.

According to a seventh aspect of the invention, in any one of first to sixth aspects, wherein the area of the predetermined region of the ejecting medium support unit side, which corresponds to the ejecting medium end portion in the second direction, includes a position corresponding to at least one side end portion of the ejecting medium in the second direction, and extends further to an outer side and an inner side of the ejecting medium than the position, and wherein a line, which connects a terminal position further to the inner side than the end portion of the ejecting medium in an area corresponding to the ejecting medium end portion of the predetermined region of the ejecting medium support unit side and a terminal position further to the outer side than the end portion of the ejecting medium in the predetermined region of the liquid ejection unit, in the side of at least one side end portion of the ejecting medium in the second direction, is configured to intersect the ejecting medium.

According to the present aspect, the line, which connects the terminal position further to the inner side than the end portion of the ejecting medium in the predetermined region (the area corresponding to the ejecting medium end portion in the second direction) of the ejecting medium support unit side and the terminal position further to the outer side than the position corresponding to the end portion of the ejecting medium in the predetermined region of the liquid ejection unit, is configured so as to be perpendicular to the ejecting medium. Thus, even if the electric field is formed between the area situated further to the inner side than the predetermined region of the ejecting medium support unit side and the liquid ejection unit, the end portion of the ejecting medium does not enter the inner side of the electric field (the details are described later).

As described above, the end portion area of the ejecting medium, in which the attachment of the paper powder and the like is the most noticeable, reliably enters the state (hereinafter, the state is called non-electric field state, for convenience) in which the electric field formed between the ejecting medium support unit and the liquid ejection unit, which are set to the identical electric potential, is extremely weak or the electric field is almost completely unformed, so that the paper powder and the like attached to the ejecting medium end portion is suppressed from being scattered and flying, whereby almost all of the paper powder and the like is discharged to the outside of the apparatus together with the ejecting medium in the state of being attached to the ejecting medium end portion. Thus, it is possible to reliably prevent the flying and attachment of the paper powder and the like to the liquid ejection unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
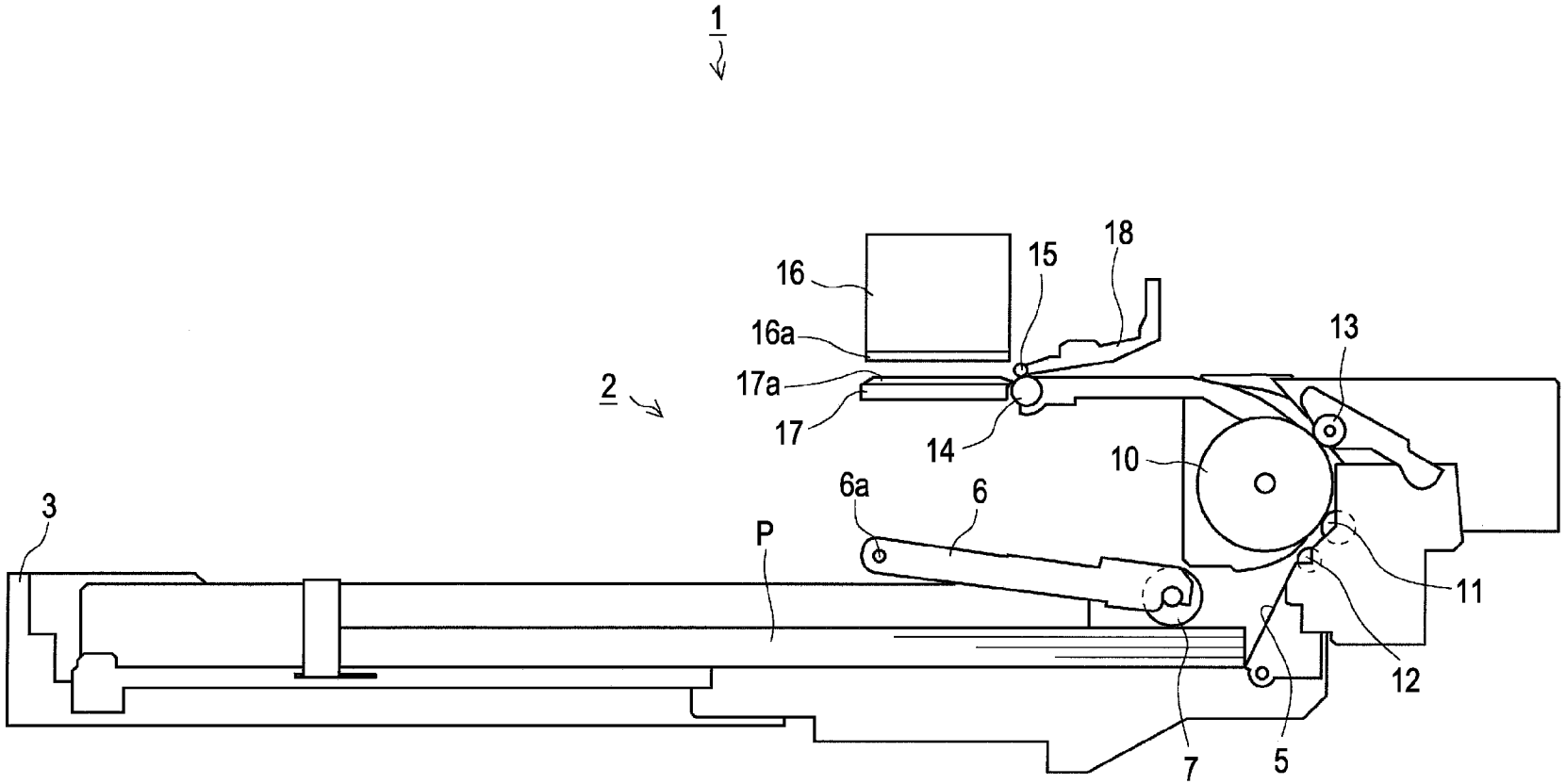
FIG. 1 is a side sectional schematic view that shows a paper transport path of a printer according to the invention.
Figure 2:
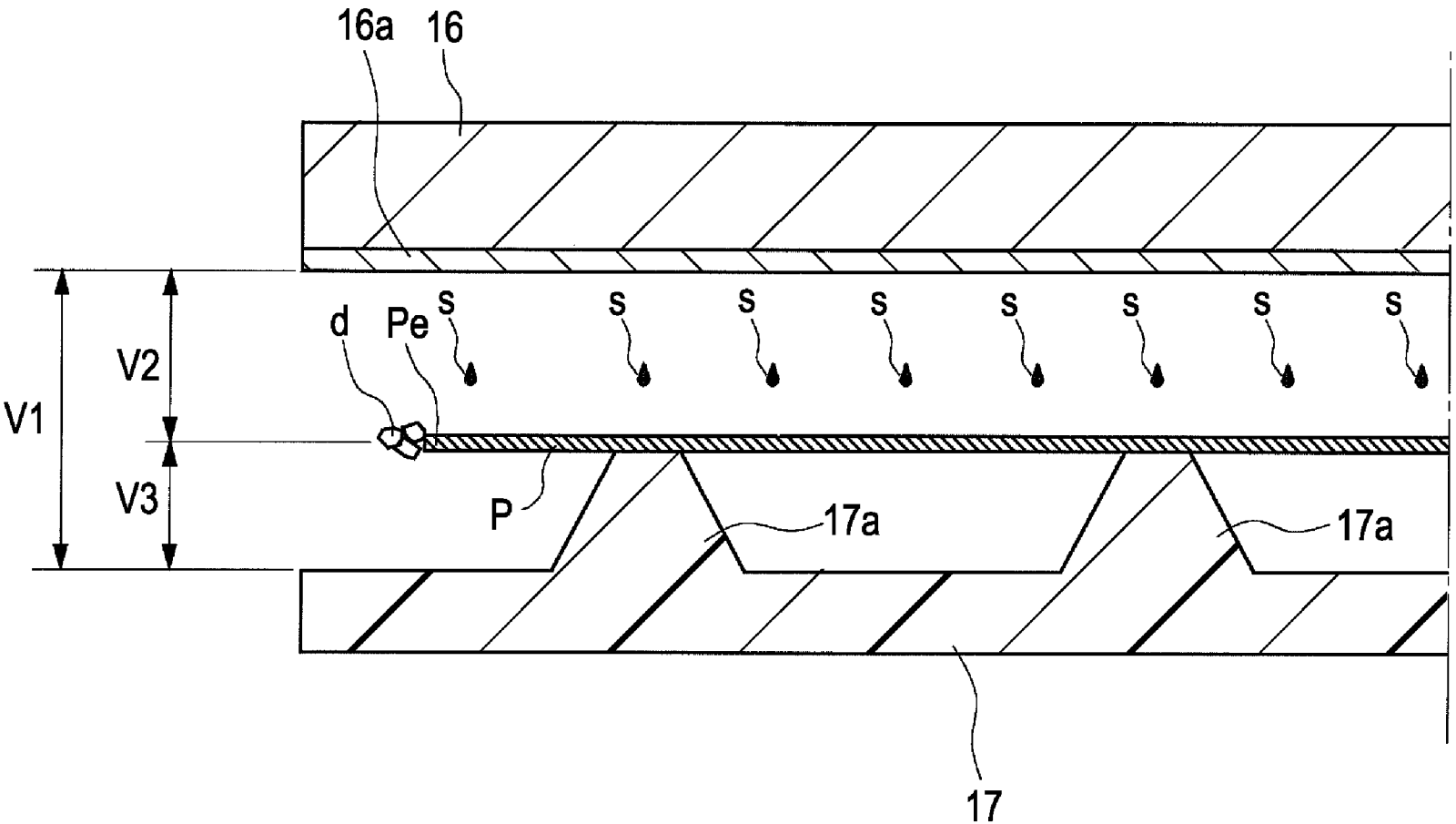
FIG. 2 is a conceptional diagram for illustrating a basic idea of the invention.
Figure 3:
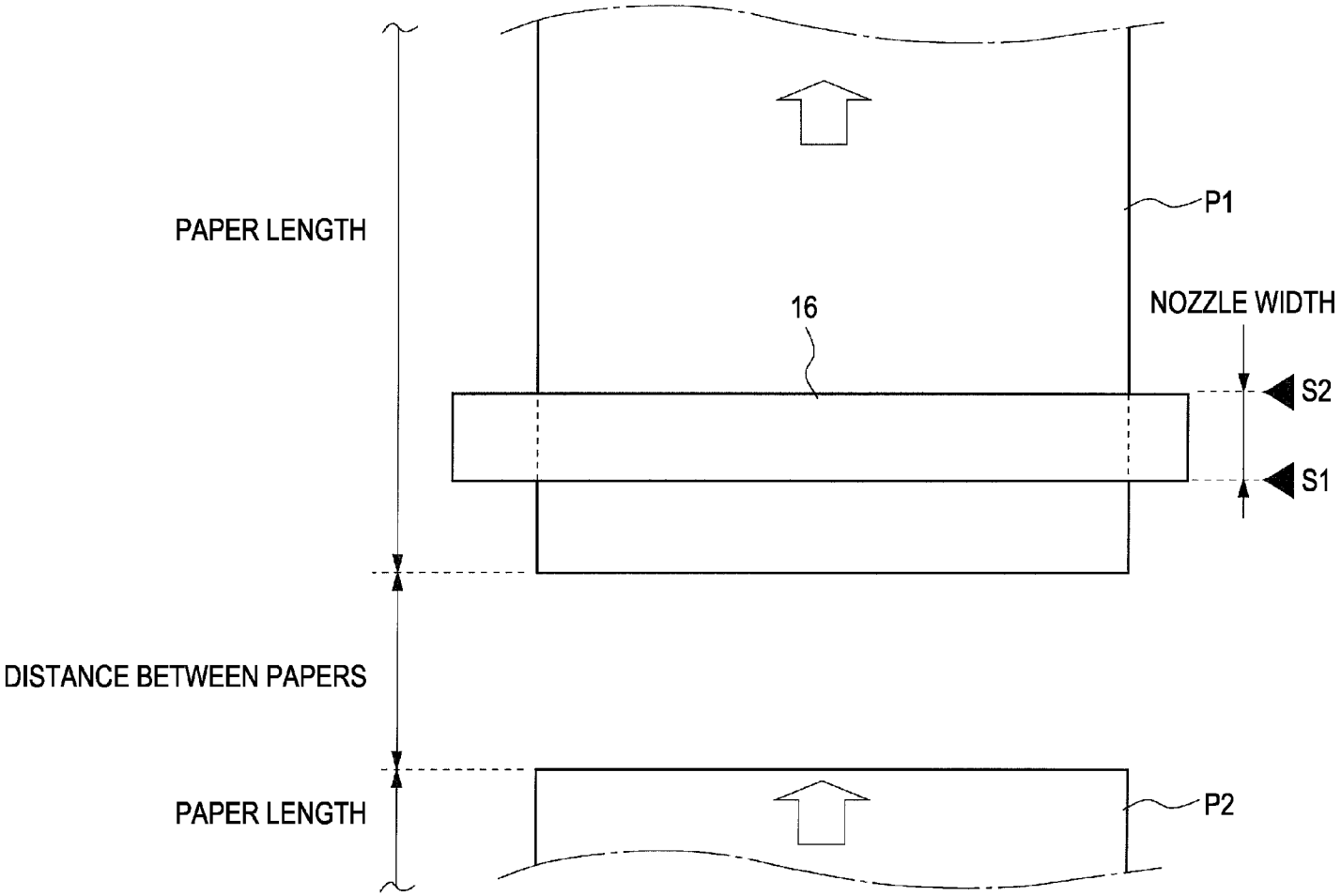
FIG. 3 is a diagram that shows a positional relationship of an ink jet recording head and a recording paper.
Figure 4:
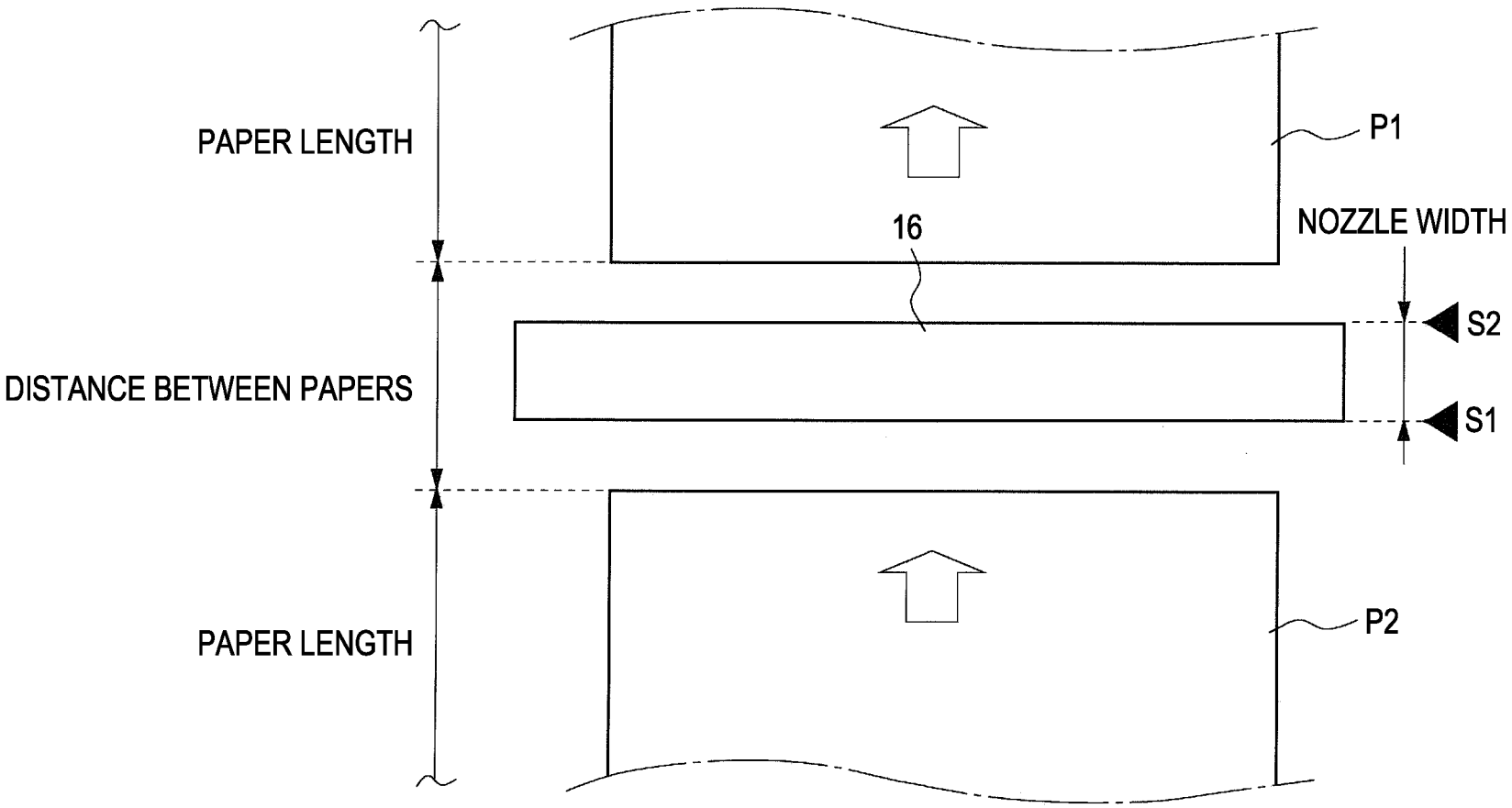
FIG. 4 is a diagram that shows a positional relationship of an ink jet recording head and a recording paper.
Figure 5:
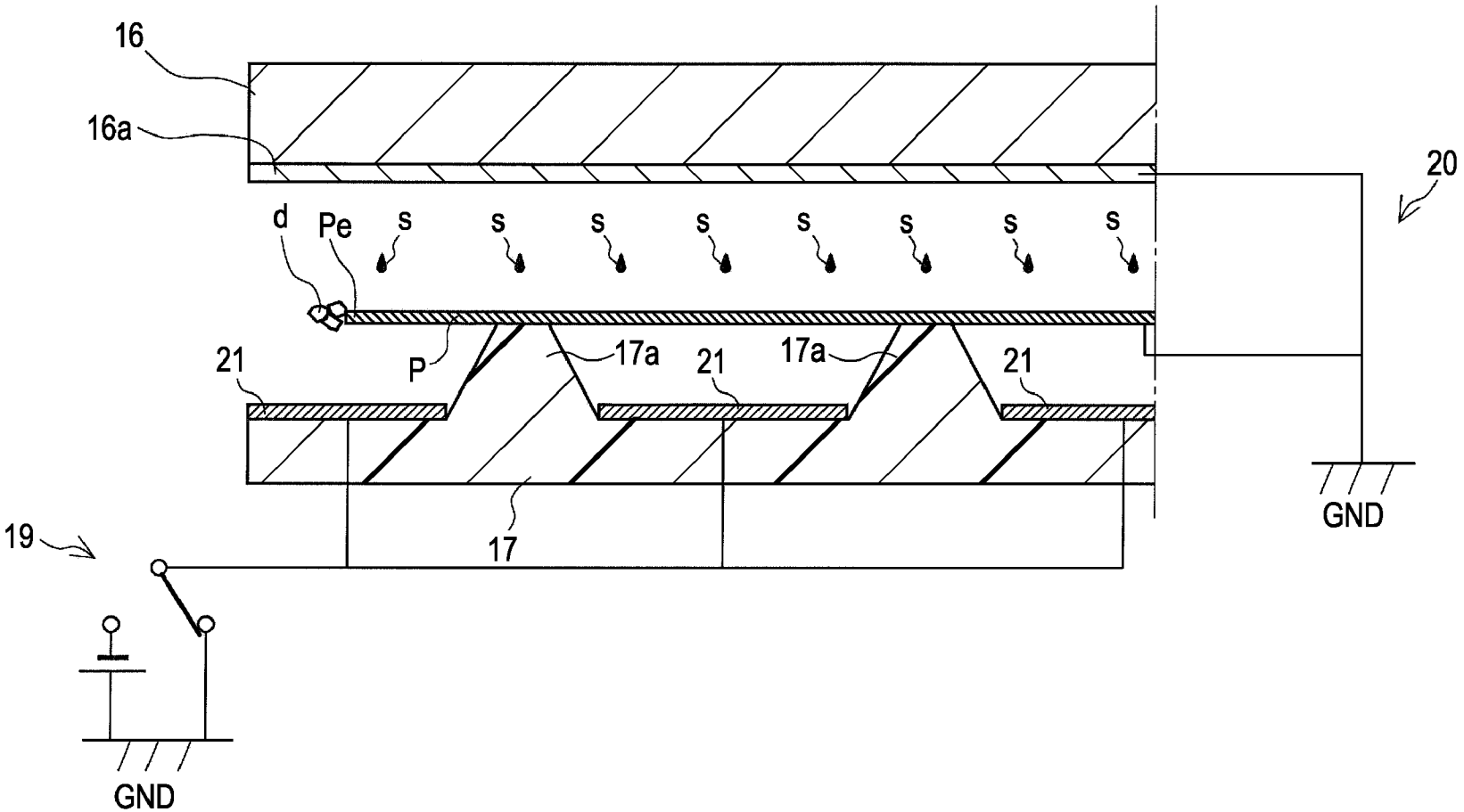
FIG. 5 is a diagram showing an electrification state in a recording area of the printer according to the invention (a first embodiment).
Figure 6:
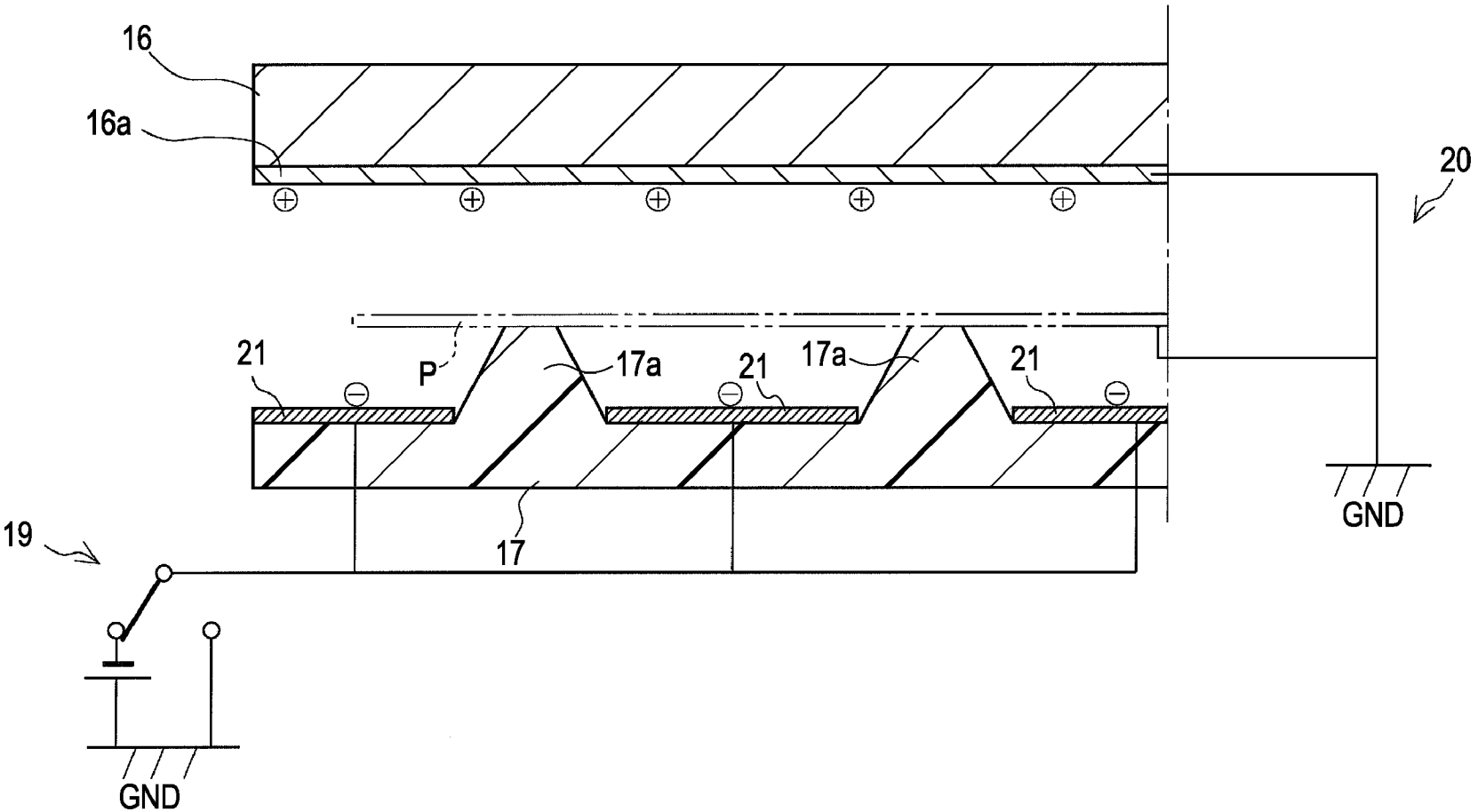
FIG. 6 is a diagram showing an electrification state in a recording area of the printer according to the invention (a first embodiment).
Figure 7:
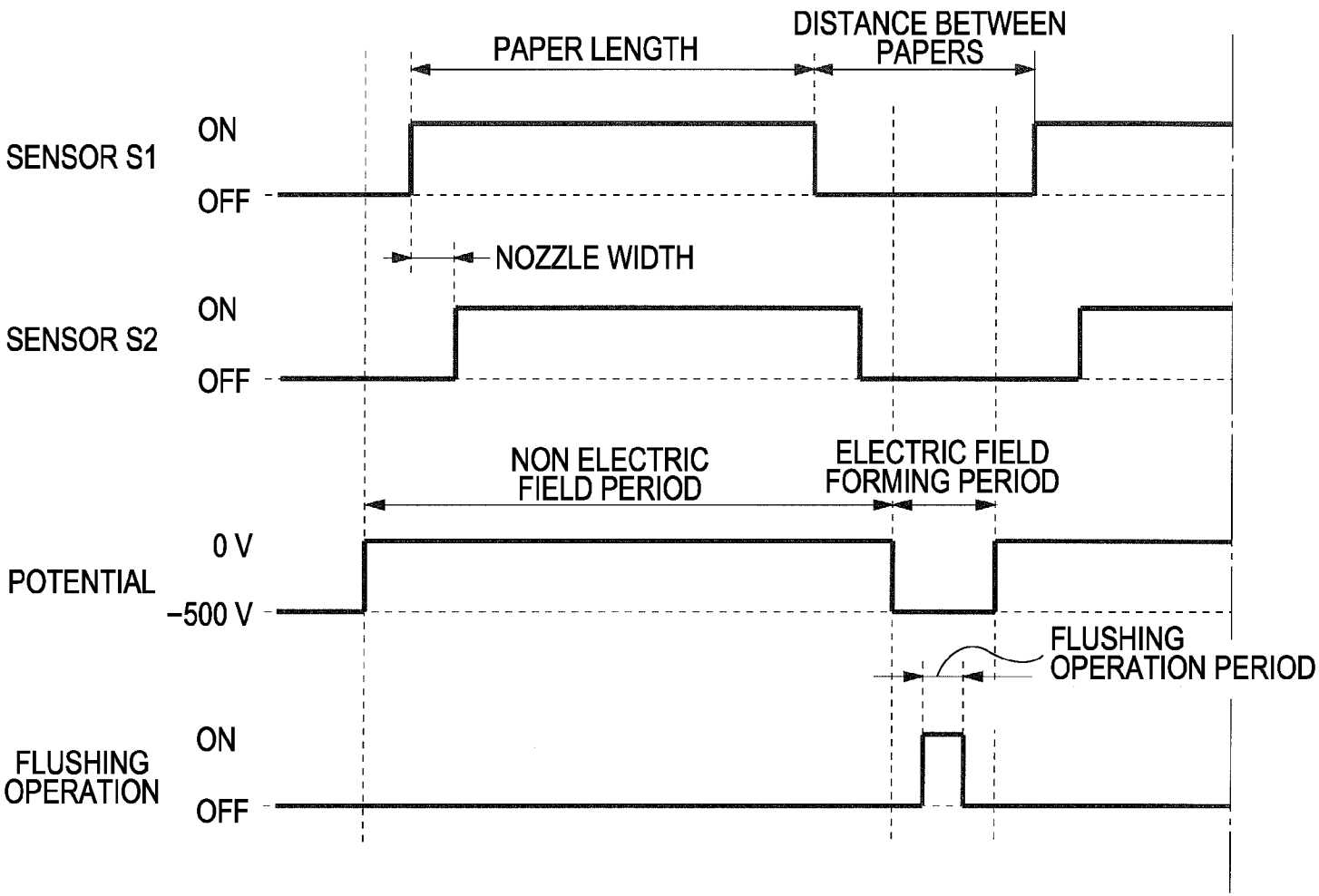
FIG. 7 is a timing chart showing an execution timing of an electric field state switching and a flushing operation relative to a passing timing of the recording paper.

Hereinafter, embodiments of the invention will be described with reference to the drawings. Herein, FIG. 1 is a side sectional schematic view that shows a paper transport path of an inkjet printer 1 according to the invention. FIG. 2 is a conceptional diagram for illustrating a basic idea of the invention. FIGS. 3 and 4 are diagrams that show positional relationships of an ink jet recording head 16 and a recording paper P. FIGS. 5 and 6 are diagrams showing an electrification state in a recording area of the ink jet printer 1 (a first embodiment). FIG. 7 is a timing chart showing an execution timing of an electric field state switching and a flushing operation relative to a passing timing of the recording paper.

Figure 8:
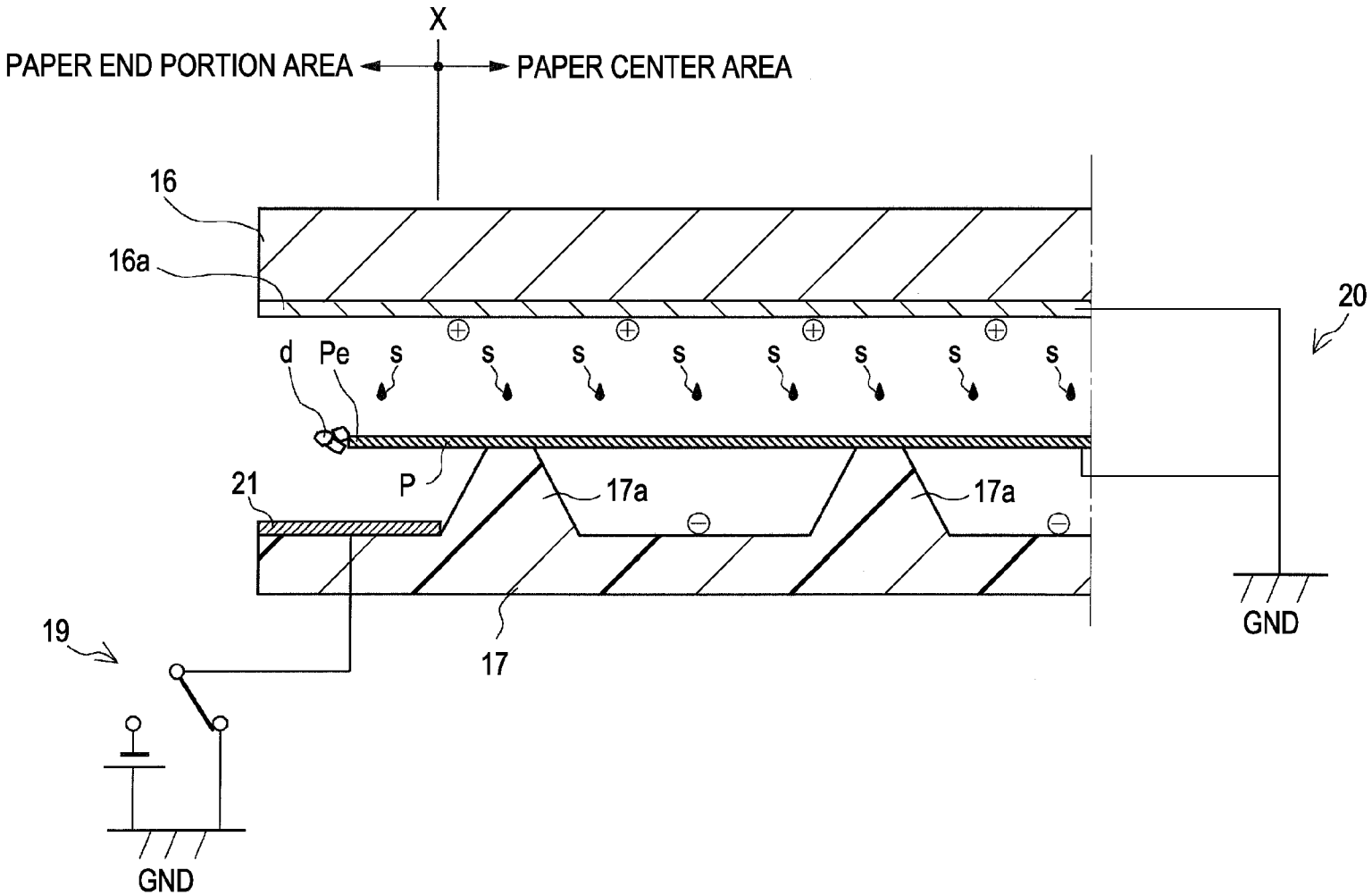
FIG. 8 is a diagram showing an electrification state in a recording area of the printer according to the invention (a second embodiment).
Figure 9:
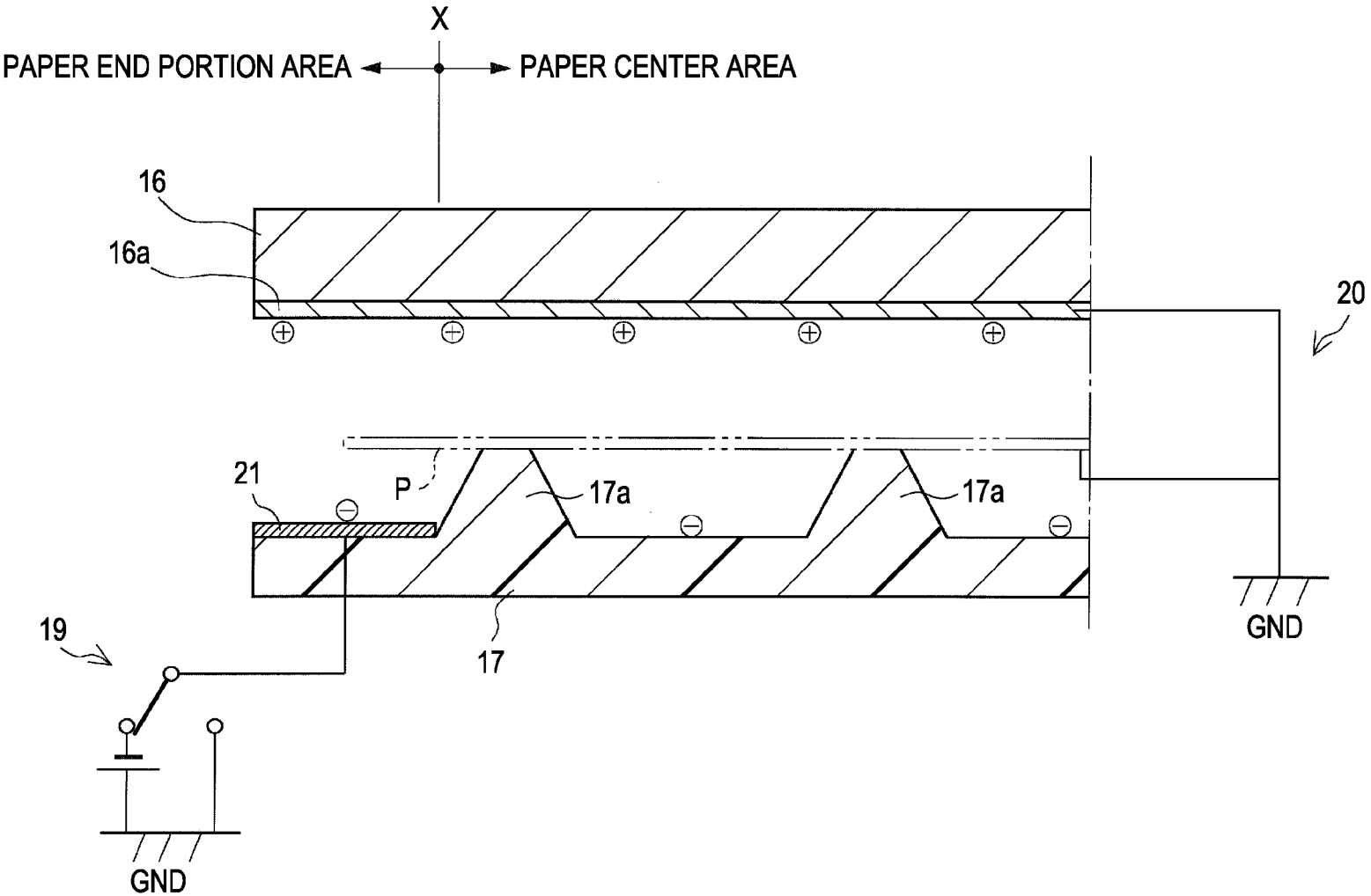
FIG. 9 is a diagram showing an electrification state in a recording area of the printer according to the invention (a second embodiment).
Figure 10:
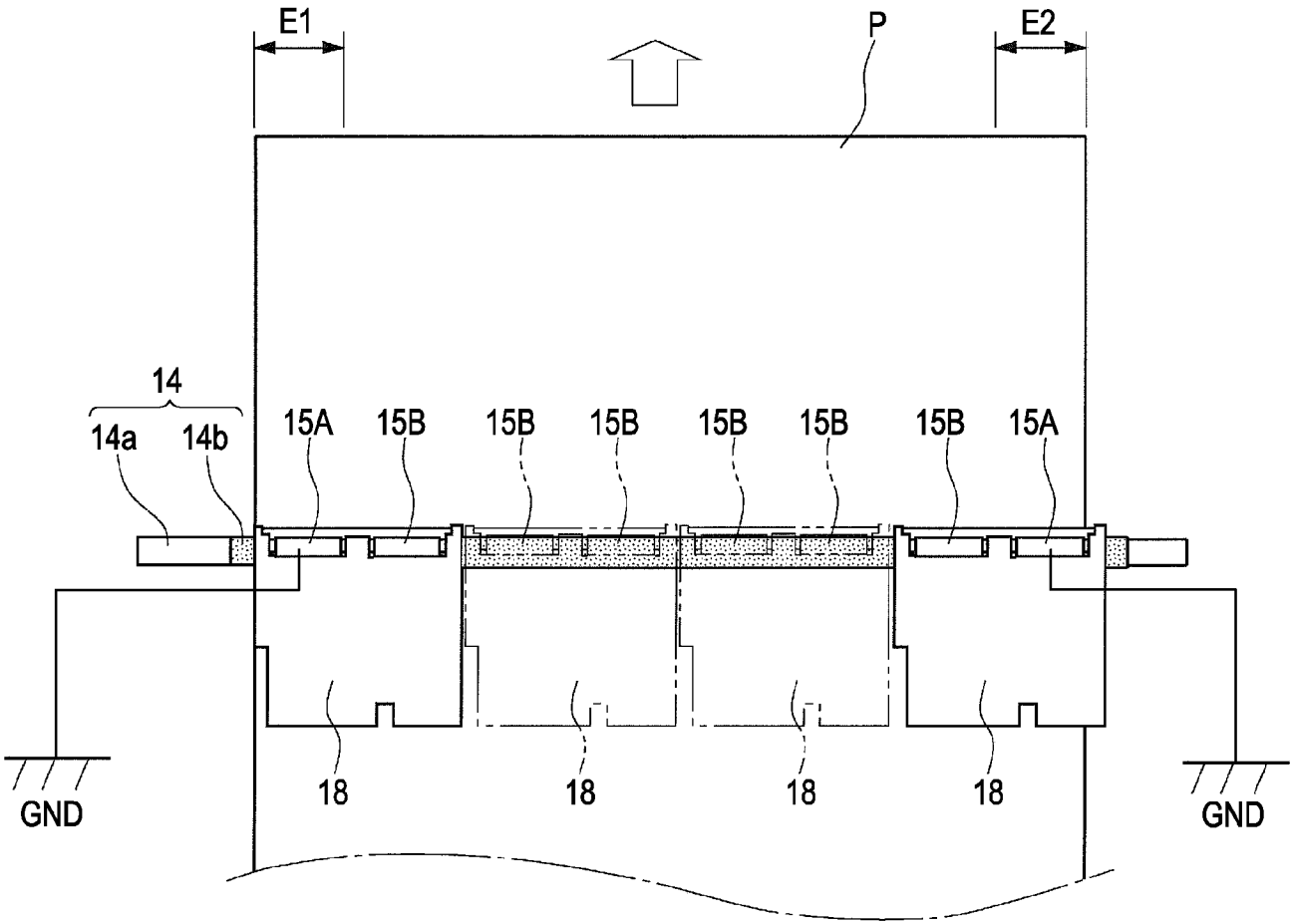
FIG. 10 is a diagram showing a unit which performs an earth connection of a paper end portion area.
Figure 11:
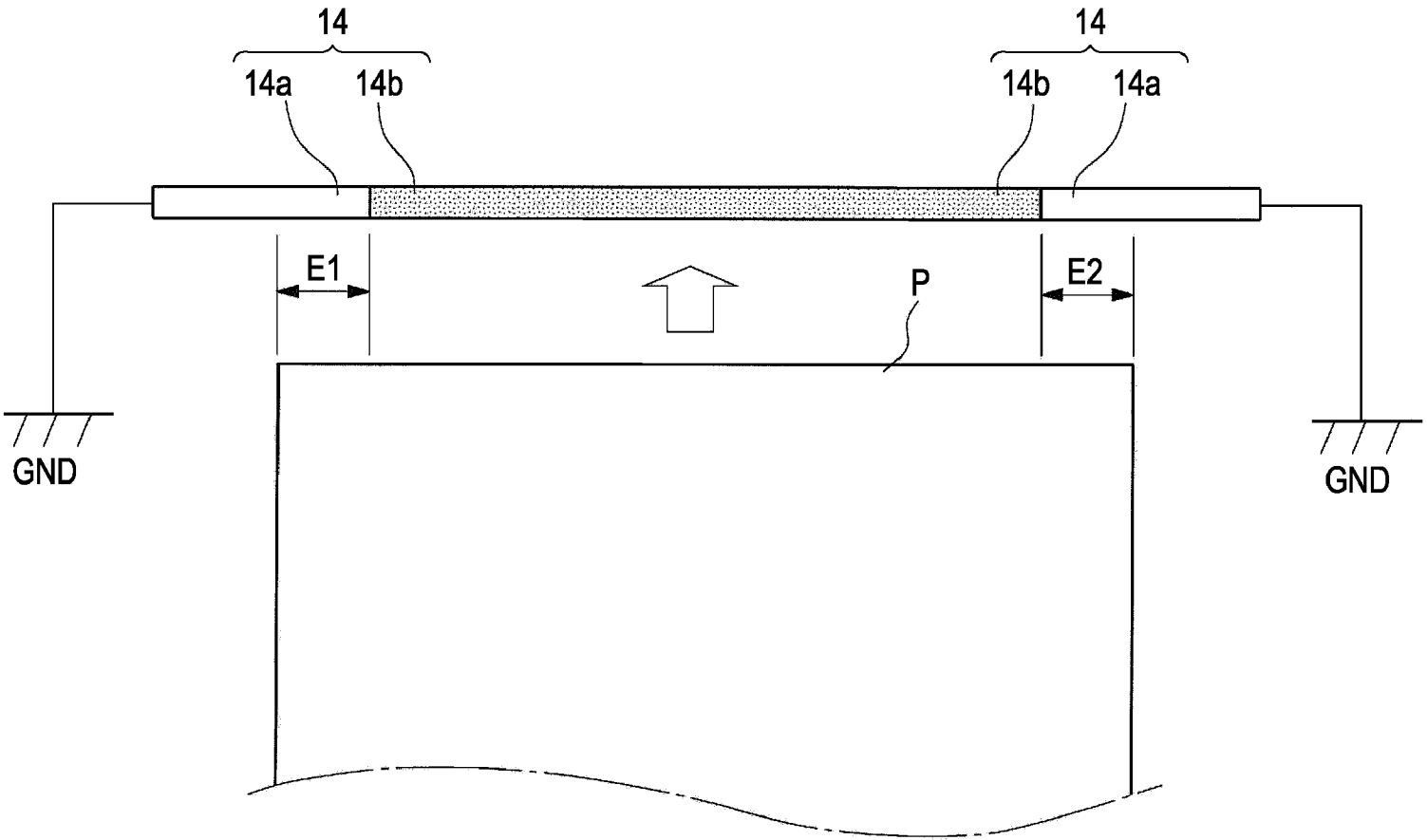
FIG. 11 is a diagram showing another embodiment of a unit which performs an earth connection of a paper end portion area.
Figure 12:
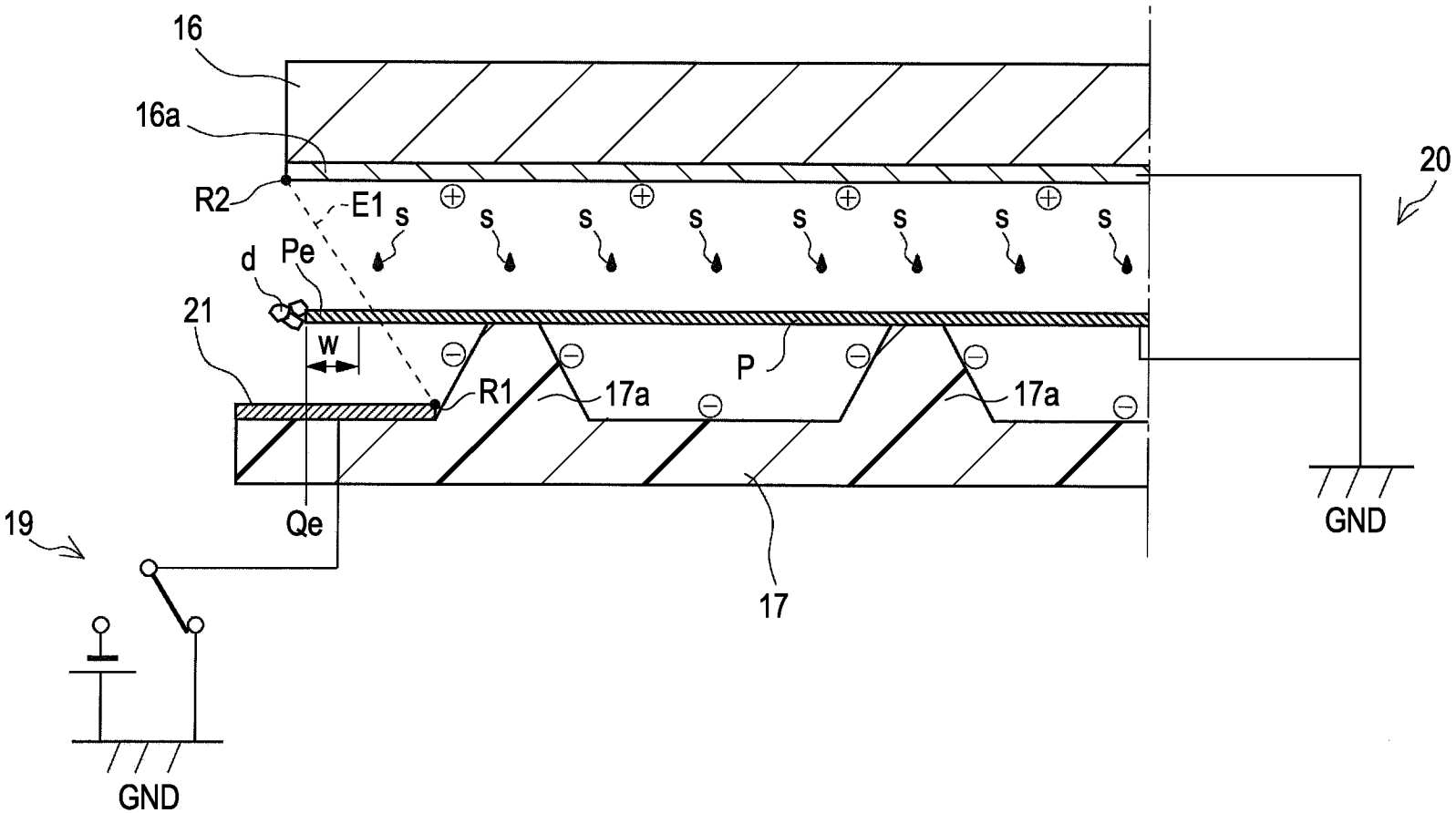
FIG. 12 is a diagram showing an electrification state in a recording area of the printer according to the invention (a third embodiment).
Figure 13:
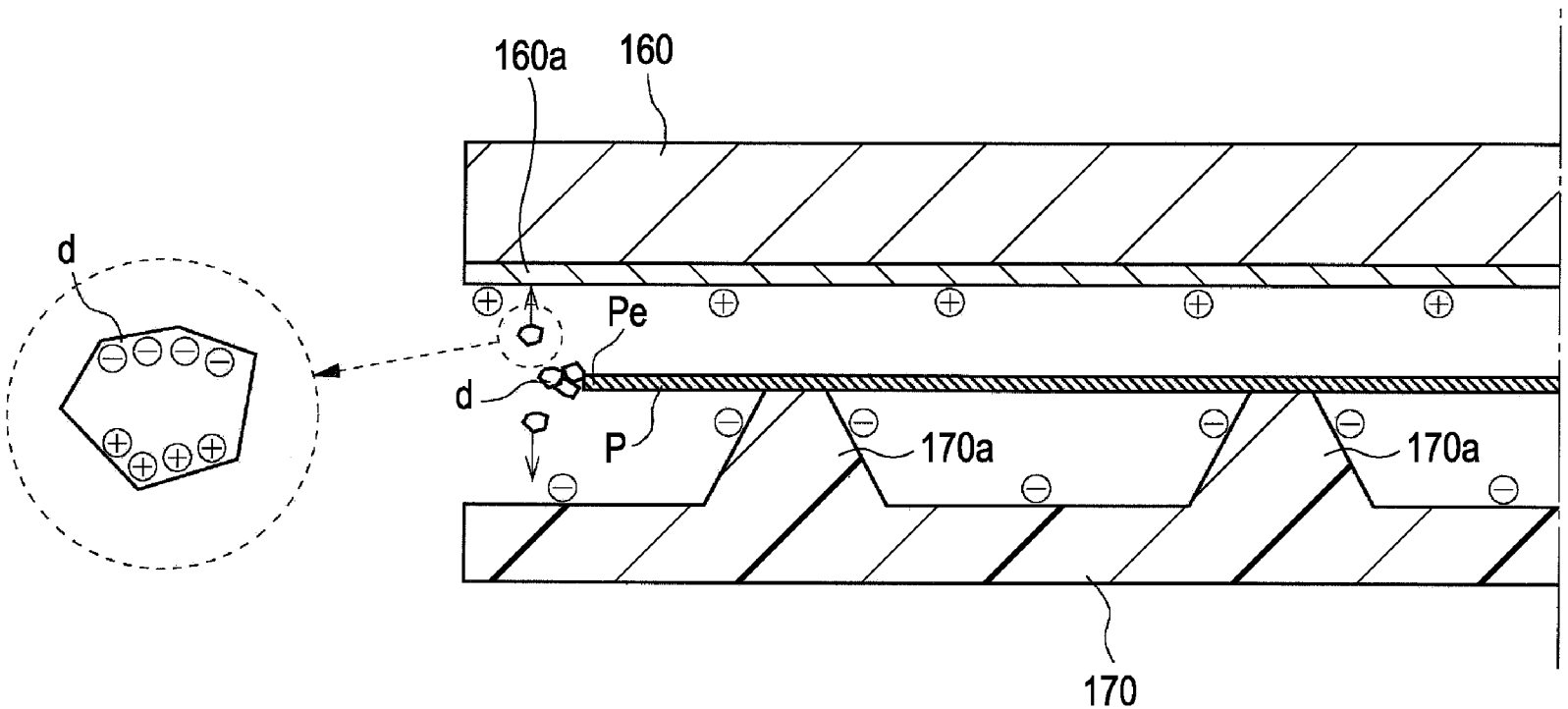
FIG. 13 is a diagram for illustrating a problem of the related art.

Moreover, FIGS. 8 and 9 are diagrams showing an electrification state in a recording area of the ink jet printer 1 (a second embodiment). FIG. 10 is a diagram showing a unit which performs an earth connection of a paper end portion area. FIG. 11 is a diagram showing another embodiment of a unit which performs an earth connection of a paper end portion area. FIG. 12 is a diagram showing an electrification state in a recording area (a third embodiment). In addition, FIGS. 5, 6, 8, 9 and 12 show one side end portion area of the paper P, and the same configuration is also provided for the other side end portion area. Moreover, a paper front surface and rear surface direction in FIG. 1 is a second direction (paper width direction) perpendicular to a first direction that is a paper transport direction. In FIGS. 2, 5, 6, 8, 9 and 12, a left and right direction of the drawing is the second direction (paper width direction), and the paper front surface and rear surface direction is the first direction (paper transport direction). Furthermore, in FIGS. 3, 4, 10 and 11, an up and down direction of the drawing is the first direction (paper transport direction), and the left and right direction of the drawing is the second direction (paper width direction).

Hereinafter, with reference to FIG. 1, an overall configuration of the ink jet printer 1, which becomes a common configuration in the respective embodiments, will be described. The ink jet printer 1 includes a configuration in which a paper feeding apparatus 2 is included at a bottom part of the apparatus, and the recording paper P as an example of an ejecting medium is delivered from the paper feeding apparatus 2, bent and reversed in a middle roller 10, and is transported to the side of an ink jet recording head 16 as a liquid ejection unit, thereby performing the recording.

More specifically, the paper feeding apparatus 2 includes a paper cassette 3, a pickup roller 7, the middle roller 10, retard roller 11, and guide rollers 12 and 13. At a position facing a front end of the recording paper P accommodated in the paper cassette 3 which can be attached to and detached from the paper feeding apparatus 2, a separation slope surface 5 is provided, so that the front end of the recording paper P delivered by the pickup roller 7 is fed to a downstream side while coming into sliding contact with the separation slope surface 5, whereby the highest recording paper P to be fed is preliminarily separated from the next recording paper P that is connected thereto and tries to be transported in an overlap manner.

The pickup roller 7 constituting the paper feeding unit is pivotally supported on an oscillation member 6 which can oscillate around an oscillation axis 6*a* in a clockwise and a counterclockwise of FIG. 1, and is provided so as to be rotated and driven by the power of a drive motor (not shown). The pickup roller 7 comes into contact with the highest recording paper P accommodated in the paper cassette 3 during paper feeding and rotates, thereby delivering the highest recording paper P from the paper cassette 3.

Next, the recording paper P delivered from the paper cassette 3 enters a bent reversal section. In the bent reversal section, the rollers including the middle roller 10, the retard roller 11 and the guide rollers 12 and 13 are provided.

The middle roller 10 is a large-diameter roller, which forms the inner side of the bent reversal path for bending and reversing the recording paper P, and is rotated and driven by a drive motor (not shown). In addition, the middle roller 10 rotates in the counterclockwise in FIG. 1, thereby transporting the recording paper P to the downstream side while winding the recording paper P.

The retard roller 11 is provided so that it can come into pressure-contact with and be separated from the middle roller 10 in the state in which a predetermined rotation frictional resistance is given. Thus, by nipping the recording paper P between the retard roller 11 and the middle roller 10, the highest recording paper P to be fed is separated from the next recording paper P which is connected thereto and attempts to be transported in an overlap manner.

Furthermore, a paper return lever (not shown) is provided in the paper feeding path around here, whereby the next recording paper P, in which the advance is restrained by the retard roller 11, is returned to the paper cassette 3 by the paper return lever.

The guide rollers 12 and 13 are rollers capable of freely rotating. Among them, the guide roller 13 assists the paper transportation by the middle roller 10, by nipping the paper P between the guide roller 13 and the middle roller 10.

The above is the configuration of the paper feeding apparatus 2. The ink jet printer including the paper feeding apparatus 2 includes a transport driving roller 14 and a transport driven roller 15, at the downstream side of the middle roller 10. The transport driving roller 14 is rotated and driven by a drive motor (not shown), and the transport driven roller 15 nips the recording paper P between the transport driven roller 15 and the transport driving roller 14 and performs driven rotation due to the transportation of the recording paper P.

An area of the downstream side of the transport driving roller 15 is a recording area where the recording is carried on the recording paper P, and the ink jet recording head 16 as the liquid ejection unit is disposed to face the support member 17 as the ejecting medium support unit which defines a distance between the recording paper P and the ink jet recording head 16 by supporting the recording paper P.

The recording paper P is recorded between (recording area) the ink jet recording head 16 and the support member 17 and is discharged to the outside of the apparatus by a discharge unit which is not shown in FIG. 1.

BASIC IDEA OF THE PRESENT INVENTION

The above is the approximate configuration of the ink jet printer 1, and the basic idea of the invention will be described with reference to FIGS. 2 to 4. Moreover, reference numeral 16*a* in FIG. 2 refers to a metallic nozzle plate formed with a plurality of ink discharge nozzles (not shown), which forms a first side facing the support member 17 in the ink jet recording head 16. Furthermore, reference numeral 17*a* is a rib extending in the paper transport direction (first direction: paper front surface and rear surface direction of FIG. 2) which is formed in the support member 17, and a plurality of ribs 17*a* is formed in the paper width direction (second direction: left and right direction of FIG. 2) with proper gaps, whereby the recoding paper P is supported by the ribs 17*a*.

Furthermore, reference numeral Pe refers to a paper end portion (an end portion in the paper width direction), and reference numeral d refers to paper powder and the like attached to the paper end portion Pe. Furthermore, reference numeral s refers to ink droplet discharged from the ink jet recording head 16 toward the recording paper P.

In addition, reference numeral V1 indicates the electric potential difference between the nozzle plate 16*a* and the support member 17 (surface facing the nozzle plate 16*a*), reference numeral V2 refers to the electric potential difference between the nozzle plate 16*a* and the recording paper P, and reference numeral V3 refers to the electric potential difference between the support member 17 (surface facing to the recording paper P) and the recoding paper P.

Furthermore, in FIGS. 3 and 4, reference numeral P1 refers to the recording paper which precedes and is transported in a white arrow direction (upper direction in the same figures), and reference numeral P2 refers to the next recording paper which is subsequently transported. Moreover, reference numerals S1 and S2 refer to sensors (e.g., optical sensors) which are disposed at an upstream side position and at a downstream side position of the ink jet recording head 16 and detect the passage of the papers.

In the invention, when the recording paper P passes through the recoding area (an area facing the ink jet recording head 16) where the recording paper P is recorded by the ink jet recording head 16 (state of FIG. 3), the electric potential difference V1 becomes zero (hereinafter, the state is called "identical electric potential state"). Moreover, when the recording paper P does not pass through the recording area (state of FIG. 4), the electric potential difference V1 is set to other than zero (that is so that the electric potential difference is generated) (hereinafter, the state is called "electric potential difference generating state") for at least a proper period.

That is, in the identical electric potential state that is set when the recording paper P passes through the recording area, the (non-electric field) state in which the electric field is not formed between the ink jet recording head 16 and the support member 17 is generated. That is, the recording paper P with the paper powder and the like d attached thereto is placed in the non-electric field area, whereby the Coulomb's force due to the electric field between the ink jet recording head 16 and the support member 17 does not act on the paper powder and the like d attached to the recording paper P. Thus, the paper powder and the like is suppressed from being scattered and flying, whereby the almost paper powder and the like d is discharged to the outside of the apparatus together with the recording paper P in the state of being attached to the recording paper P. Thus, it is possible to reliably prevent the flying and attachment of the paper powder and the like d to the ink jet recording head 16.

Furthermore, in the electric potential difference generating state that is set when the recording paper P does not pass through the recording area, the electric field is formed between the ink jet recording head 16 and the support member 17, so that the Coulomb's force due to the electric field acts on the ink droplets s (particularly, the droplets which become mist and float) ejected from the ink jet recording head 16. Thus, the ink droplets s can be attracted to the recording paper P or the support member 17, which makes it possible to solve the problems due to the fact that the ink droplets s are atomized to a mist and float.

Furthermore, when the electric potential difference V1 and the electric potential difference V2 are set to zero in the identical electric potential state, the recording paper P is placed in the complete non-electric field area, which makes it possible to more reliably suppress the paper powder and the like d attached to the recording paper P from flying toward the ink jet recording head 16 and being attached thereto.

The above is the basic idea of the invention.

First Embodiment

Hereinafter, an electrification state (a first embodiment) in the recording area will be described with reference to FIGS. 5 and 6. In addition, in the present embodiment and a second embodiment described later, the ink jet recording head 16 is a so-called line head which is formed so as to have a length covering the paper width, and the recoding can be carried out by moving only the recording paper P in the transport direction (a first direction) without moving the ink jet recording head 16 back and forth in the paper width direction (a second direction).

In FIGS. 5 and 6, reference numerals 19 and 20 refer to electric potential control units. The electric potential control units 19 and 20 are units for switching between an identical electric potential state (FIG. 5) in which the nozzle plate 16*a*, the support member 17, and the recording paper P are set to the identical electric potential and an electric potential difference generating state (FIG. 6) which forms the electric potential difference among them.

More specifically, on the surface (between the nozzle plate 16*a* and the rib 17*a*) in the support member 17 facing the nozzle plate 16*a*, an electrode plate (e.g., a SUS plate having a width of about 20 mm) 21 is provided. The electrode plate 21 is configured so that the power supply connection (e.g., a negative terminal of 500V power source) and the earth connection can be switched by a switch. Furthermore, in the present embodiment, although the electrode plate 21 can be connected to the negative terminal of the power supply, the electrode plate 21 may be connected to the positive terminal. Moreover, the electrode plate 21 is configured so as to have the length and the arrangement position which covers at least the ink jet recording head 16 in the first direction.

Furthermore, the electric potential control unit 20 performs the earth connection of the nozzle plate 16*a* and the recording paper P. The nozzle plate 16*a* and the recording paper P are always maintained at the identical electric potential (ground electric potential) by the electric potential control unit 20. Furthermore, places in the electric potential control unit 20 which come into contact with the recording paper P can be configured by, for example, forming the roller of the upstream side from the recoding area including the transport drive roller 14 by the conductive material, or can be configured by a conductive brush or the like.

When the recording paper P passes through the recoding area (the state of FIG. 3), the electric potential control unit 19 selects the earth connection of FIG. 5, whereby the nozzle plate 16*a*, the support member 17, and the recording paper P become the identical electric potential (the ground electric potential), so that they enter the non-electric field state. As a result, when the recording paper P with the paper power and the like d attached thereto passes through the recording area, the Coulomb's force due to the electric field does not act on the paper powder and the like d, whereby it is possible to reliably prevent the flying and attachment of the paper powder and the like d to the ink jet recording head 16. Furthermore, in FIG. 5, in order to obviate the complexity of the drawings, the electric force line is not shown (similar to FIGS. 8 and 9).

In addition, when the recording paper P does not pass through the recording area (the state of FIG. 4), specifically, in a case where the portion between the preceding recording paper P1 and the consecutive recording paper P2 passes through the recording area, the electric potential control unit 19 selects the power supply connection of FIG. 6, whereby the electric field is formed between the nozzle plate 16*a* and the support member 17.

In FIG. 6, symbols "+" and "−" surrounded by circles refer to the electrification polarity (similar to FIG. 8). Since the negative electric charge appears on the electrode plate 21 and the positive electric charge appears on the side of the nozzle plate 16*a* due to the electrostatic induction in the example of FIG. 6, the ink droplet discharged from the ink jet recording head 16 is electrified to the plus. Thus, if the ink mist floats, the ink mist is attracted to the side of the support member 16, whereby the floating ink mist can be collected.

FIG. 7 shows the timing chart of each operation. As shown, from when both of the sensors S1 and S2 are in the ON state (a state in which the recording paper P1 is in the recording area) to when, after the sensor S1 is completely switched to OFF, the sensor S1 is switched to ON again is between the papers of the recording papers P1 and P2. The electric potential difference generating state (electric field forming state) is formed between the papers.

Furthermore, in the present embodiment, in the electric potential difference generating state (the electric field forming state) the empty discharging (flushing) of the ink from the ink jet recording head 16 is performed. As a result, during flushing when a great quantity of ink droplet is discharged, the ink droplet is prevented from becoming the mist and floating.

Furthermore, the switching from the electric potential difference generating state (the electric field forming state) to the identical electric potential state (non-electric field state) is performed, for example, before the passage of the front end of the recording paper P1 is detected by the sensor S1 (before the front end of the recording paper P1 enters the recording area). As a result, the paper powder and the like attached to the front end of the paper is reliably prevented from flying and being attached to the ink jet recording head 16. Furthermore, in order to reliably perform the control, it is desirable to further provide a sensor (a paper passage detection unit) on the upstream side of the sensor S1.

Moreover, the switching from the identical electric potential state (non-electric field state) to the electric potential difference generating state (electric field forming state) is performed, for example, after the passage of the rear end of the recording paper P1 is detected by the sensor S2 (after the rear end of the recording paper P2 comes out of the recoding area). As a result, the paper powder and the like attached to the rear end of the paper is reliably prevented from flying and being attached to the ink jet recording head 16.

Second Embodiment

Hereinafter, a second embodiment of the invention will be described with reference to FIGS. 8 and 9. Moreover, the constituents already described are denoted the same reference numerals, and the descriptions thereof will be omitted hereinafter (similar to other embodiments described later).

The invention is different from the first embodiment already described in that the electric potential difference (electric field) state is changed in the end portion area of the recording paper P and the center area except for the end portion area. More specifically, the electrode plate 21 is provided on the paper end portion area (at the left side from the X position in the same drawing) including the end portion Pe of the recoding paper P, and the electrode plate 21 is not provided on the rest center area.

For this reason, when the recoding paper P passes through the recording area, that is, when the electric potential control unit 19 selects the earth connection (the state of FIG. 8), in the paper end portion area, the nozzle plate 16*a*, the support member 17, and the recording paper P become the identical electric potential (the ground electric potential), whereby they enter the non-electric field state. As a result, while the paper end portion in which the attachment of the paper powder and the like d is noticeable passes through the recording area, the Coulomb's force due to the electric field does not act on the paper powder and the like d, whereby it is possible to reliably prevent the flying and attachment of the paper powder and the like d to the ink jet recording head 16. Furthermore, the width (the distance from the paper edge to the position X) of the paper end portion area can be suitably adjusted in response to the attachment situation of the paper powder and the like d, for example, the width can be set to about 2 mm, in which the attachment is most noticeable, or can be set to a range (e.g., about 2 to 5 mm) in which a slight margin is provided compared to that, that is, the width can be suitably adjusted in response to the degree of the attachment of the paper powder and the like d. In addition, the electrode plate 21 is configured so as to have the width and the arrangement position which covers the paper end portion area.

At this time, since the electrode plate 21 is not provided in the paper center area, there is a state in which the electric field can be formed between the nozzle plate 16*a* and the support member 17 by the electrification of the support member 17. That is, the control of the electric potential difference (electric field) between the nozzle plate 16*a* and the support member 17 is not performed (none control) by providing the exclusive electric potential difference generating unit. However, since the support member 17 is formed by the resin material in the present embodiment and has a property as the dielectric, the support member 17 is electrified by the friction between the support member 17 and the recording paper P, with the result that there is a state in which the electric potential difference (electric field) can be formed between the support member 17 and the nozzle plate 16*a*.

Thus, the discharged ink droplet s can be attracted to the side of the recording paper P between the nozzle plate 16*a* and the recording paper P by the Coulomb's force, and reliably impact on the recording paper P, which makes it possible to solve the problem of the ink mist float.

Furthermore, when the recording paper P does not pass through the recording area (the state of FIG. 9), the electric potential difference (electric field) between the nozzle plate 16*a* and the support member 17 in the center area except for the paper end portion area is not controlled (none control), but the electric potential difference (electric field) is formed between the nozzle plate 16*a* and the support member 17 due to the frictional electrification of the support member 17. Thus, it is possible to collect the floating ink mist to the support member 17 side.

Other Variation

1. Electric Potential Control Unit

In the above-mentioned respective embodiments, in order to put the nozzle plate 16*a*, the recording paper P, the support member 17 into the identical electric potential (to form non-electric field state), they are subjected to earth connection. However, since, if they are the identical electric potential, none electric state can be formed, arbitrary voltage of arbitrary polarity may be applied without being limited to the earth connection.

Moreover, in the above-mentioned embodiment, when the recording paper P passes through the recording area, the nozzle plate 16*a*, the recording paper P and the support member 17 can be put into the identical electric potential. However, even by a configuration in which only the portion between the nozzle plate 16*a* and the support member 17 is put into the identical electric potential and the recording paper P is not subjected to electric potential control (floating), a predetermined attachment prevention effect of the paper powder and the like (the attachment prevention effect of the paper powder and the like to the nozzle plate) can be obtained.

Furthermore, in the second embodiment, in order to put an area corresponding to an end portion of recording paper of a certain size (e.g., A4 size) into the none electric state, the electrode plate 21 is disposed only at the paper end portion area. However, a plurality of areas, which are put into non-electric field, may be disposed in response to the size (in the paper width direction) so that the areas can correspond to the recoding papers of a plurality sizes.

In this case, in the case of the paper of small size, the outer side of the area (paper end portion area), which is set to the non-electric field state, becomes the electric field forming area, which makes it possible to prevent the scattering of the ink mist in the outer area of the recording paper P.

Moreover, a period during which the electric potential control unit forms the electric potential difference (electric field) among the nozzle plate 16*a*, the recording paper P, and the support member 17 in FIG. 7 is a time when the recording paper P does not pass through the recording area (when the portion between the papers passes through the recording paper) as described above. However, the electric field forming period may be a suitable period of time when at least the recording paper P does not pass through the recording area. That is, the electric field may be formed using the whole period during which the recording paper P does not pass through the recording area, and the electric field may be formed using a partial period. Furthermore, the electric field may be formed using the period before and after the recording start.

2. Ink Jet Recording Head

In the respective embodiments, as the ink jet recording head 16, the fixed type (line head) which is not moved in the paper width direction is used. However, a serial type which performs the recording while moving in the paper width direction may be used without being limited thereto.

Moreover, in the respective embodiments, a water repellent film may be provided on the surface of the nozzle plate 16*a*. Herein, if a conductive water repellent film is used, the electrification of the water repellent film can be suppressed, which can suppress the paper powder and the like from being attached to the nozzle plate 16*a* and can reliably control the electric potential of the nozzle plate side.

Furthermore, if an insulating water repellent film is used, it is possible to reduce mirror image force (a phenomenon in which when the paper powder and the like with the electric charge comes closer to the nozzle plate, the opposite electric charge appears on the nozzle plate side, whereby the electric charges attract each other) of the nozzle plate 16*a* formed of the metal such as the SUS, which can prevent the paper powder and the like flying up in the vicinity of the nozzle plate from being attracted to the nozzle plate 16*a*.

Moreover, a predetermined region, which gives the electric potential (controlling), is preferably furthest support member 17 side, that is, the nozzle plate 16*a*, in the ink jet recording head 16. More specifically, a predetermined region is preferably a nozzle surface that is a surface facing the support member 17. As a result, the electric potential of the nozzle surface which is closest to the recording paper P is controlled, which can suppress the turning electric field from the surroundings and can effectively prevent the attachment of the paper powder and the like to the nozzle surface. Furthermore, this is also true for the support member 17 side, and a determined region in which the electric potential is controlled is preferably a surface facing the nozzle plate 16*a*. Moreover, with a configuration in which the electric potential of the support member 17 and the recording paper P side is switched without switching the electric potential of the ink jet recording head 16 side as in the respective embodiments, reliability of the ink jet recoding head 16 can be improved.

3. Electrode Plate

In the respective embodiments, an ink absorbent material (not shown) may be provided on the surface of the electrode plate 21. Even if the ink droplet is discharged to an area (e.g., during flushing when the ink is empty discharged, during printing without edge or the like) deviated from the recording paper P, the ink absorbent material can catch the discharging, which can reliably solve the problem of the mist floating.

The ink absorbent material can be formed so as to have conductivity with surface resistivity of, for example, 102 to 108Ω/Sg (e.g., about 105Ω/□). Specifically, it is possible to use one in which conductive materials such as metal and carbon are mixed with resin such as polyethylene and polyurethane and then are foamed, one in which conductive materials such as metal and carbon are attached to resin foam materials such as polyethylene and polyurethane, a plated one or the like. Furthermore, it is possible to use one in which electrolytic solution is impregnated in resin foam materials such as polyethylene and polyurethane. In this manner, by giving the ink absorbent material conductivity, the electric potential of the surface-most (the surface most of the nozzle plate side) of the ink absorbent material can be reliably controlled. Furthermore, such conductive ink absorbent material may be used instead of the electrode plate 21.

4. Ground Unit of Recording Paper

Furthermore, in the respective embodiments, the earth connection of the recording paper P can be performed by various units, and, for example, a conductive brush, which is earth connected to an arbitrary place, may be arranged so as to be brought into contact with the recording paper P.

Furthermore, the earth connection may be performed via the respective rollers arranged on the paper transport path. In addition, at that time, it may be configured so as to preponderantly control the electric potential only at the paper end portion. FIGS. 10 and 11 show an example thereof. A transport driven roller indicated by reference numeral 15A in FIG. 10 is a transport driven roller, which is provided at the end most portion in the paper width direction, is formed by the conductive material and is earth connected. Thus, the end portion area (shown by symbols E1 and E2) of the recording paper P is configured so as to be earth connected and preponderantly become ground electric potential.

Furthermore, reference numeral 18 shows an upper guidance member which supports the transport driven rollers 15A and 15B in freely rotatable manner. Furthermore, the transport driven roller shown by the reference numeral 15B is a roller formed by an insulating material. However, alternatively, the transfer driven roller 15A, which is formed by the conductive material and is earth connected, may be adopted all over the paper width direction.

Furthermore, the transport driving roller 14 with which the transport driven rollers 15A and 15B come into press contact is formed by attaching abrasion resistant particles to a surface of a metallic shaft body so that the frictional force between the transport driving roller 14 and the recording paper P can be raised. Reference numeral 14*a* shows a metal surface to which the abrasion resistant particles are not attached, and reference numeral 14*b* shows a high friction surface (which has a property as the dielectric in the present embodiment) to which the abrasion resistant particles are attached.

Thus, as shown in FIG. 11, by extensively providing the metal surface 14*a* in the inner side of the paper transport area, so that the paper end portion areas E1 and E2 are formed by the metal surface 14*a* and are earth connected, the end portion areas E1 and E2 of the recording paper P can be earth connected, which predominantly can make the paper end portion area the ground electric potential.

5. Electric Charge Provision to Ink Droplet

In the above-mentioned embodiment, the ink droplet is electrified by the induction charge via the nozzle plate 16*a*. However, the electric charge may be given to the ink droplet at an arbitrary place in the ink flow path from an ink accommodating chamber (e.g., ink cartridge and the like) to the nozzle plate 16*a*. For example, a part or all of the inner wall of the ink accommodating chamber is formed of the conductive material, so that the electric charge may be given to the ink via the inner wall.

Furthermore, by giving the ink as liquid the same electric potential as the support member 17 side (or the recording paper), it is possible to greatly weaken the electric field between the ink jet recording head 16 and the support member 17 (or the recording paper), whereby the paper powder attachment prevention measures to the nozzle plate 16*a* can be constituted. That is, for example, the nozzle plate 16*a* can be formed by the dielectric such as silicone, acryl, and polyimide without being limited to the conductor such as metal. In this case, if the electric potential of the ink in the head is not controlled, the electric field due to the electric potential difference between the ink in the head and the support member 17 has a great effect on the paper powder, whereby the paper powder may fly up to the nozzle plate 16*a* side. However, by giving the ink in the head the same electric potential as the support member 17 side, the above-mentioned problem can be solved.

Furthermore, in a case where the nozzle plate 16*a* is formed of the dielectric, as configuration that gives the ink in the head the electric potential, it is also possible that only the ink flow path portion (region contacting the ink) in the nozzle plate is formed by the conductive material, whereby the electric potential is given to the ink via the conductive material. For example, in a case where the nozzle plate has a laminated structure, the ink flow path portion in the whole layers may be constituted by the conductive member, and the ink flow path portion in at least one of the layers may be constituted by the conductive member.

6. Configuration Considering the Electric Field Formed by Area Other than the Electrode Plate Arrangement Area in the Support Member In the respective embodiments, by the configuration considering the electric field formed by the area other than the electrode plate arrangement area in the support member 17, the scattering and flying of the paper powder and the like can be more reliably prevented. Hereinafter, this will be described with reference to FIG. 12. Furthermore, FIG. 12 is a modified example of the second embodiment shown in FIGS. 8 and 9.

Herein, in FIG. 12, a point R1 shows a terminal position of a paper inner side (a right side in FIG. 12) than a position (a position of the support member 17 when drawing the vertical line from the paper end portion toward the support member 17) Qe corresponding to the paper end portion in the electrode plate 21. A point R2 shows a terminal position of a paper outer side (a left side in FIG. 12) than the position Qe corresponding to the paper end portion in the nozzle plate 16*a*. Furthermore, a line shown by reference numeral E1 shows a line connecting the point R1 and the point R2.

For example, since in FIG. 12, the paper inner side (the right side in FIG. 12) than the electrode plate 21 in the support member 17 is an area formed of the resin material, there is a fear that the electric field may be formed between the support member 17 and the nozzle plate 16*a* in the area of the paper inner side (the right side in FIG. 12) than the line E1. That is, even if the paper end portion area with the paper powder and the like d attached thereto is pinched between the electrode plate 21 and the nozzle plate 16*a*, the electric field is generated. Thus, if the paper end portion area is squeezed into the electric field, there is a fear that the paper powder and the like d attached to the paper end portion area may be scattered and fly toward the nozzle plate 16*a*.

However, by configuring so that the line E1 is situated at the paper inner side (the right side in FIG. 12) than the paper end portion area, that is, the line E1 intersects the paper, it is possible to reliably put the paper end portion area in the non-electric field state. As a result, it is possible to reliably prevent the paper powder and the like d attached to the paper end portion area from being scattered and flying toward the nozzle plate 16*a*.

Furthermore, in the present embodiment, with respect to the area of the distance w from the paper end portion to the inner side, it is configured so that the line E1 passes the paper inner side. However, if it is configured so that the line E1 passes at least to the inner side than the paper end portion (edge), a predetermined paper powder scattering prevention effect can be obtained. Furthermore, considering the degree of the attachment of the paper powder and the like d, for example, the distance w can be set to about 2 mm in which the attachment is the most noticeable, or can be set to a range (e.g., w=about 2 to 5 mm) in which a slightly smaller margin is provided than that, that is, the distance can be suitably adjusted in response to the degree of the attachment of the paper powder and the like d.

Moreover, in the above-mentioned embodiment, the invention is applied to both of one side end portion and the other side end portion of the paper P. However, the invention is not limited to this configuration, but it is needless to say that a working effect can be obtained at the one side end portion area even when the invention is applied to only one side end portion area of the paper P.

What is claimed is:

1. A liquid ejecting apparatus which includes a liquid ejection unit for ejecting liquid to an ejecting medium, and an ejecting medium support unit that is disposed oppositely to the liquid ejection unit and supports the ejecting medium, comprising:

an electric potential control unit capable of switching between an identical electric potential state which sets a predetermined region of the liquid ejection unit side and a predetermined region of the ejecting medium support unit side to the identical electric potential and an electric potential difference generating state which generates the electric potential difference between both of them, wherein the liquid ejecting apparatus includes a configuration in which, when the ejecting medium passes through a liquid ejecting area to which the liquid is ejected by the liquid ejection unit, the electric potential control unit forms the identical electric potential state, and when the ejecting medium does not pass through the liquid ejecting area, the electric potential control unit forms the electric potential difference generating state for at least a proper period.

2. The liquid ejecting apparatus according to claim 1, wherein the electric potential control unit sets the ejecting medium and the predetermined region of the liquid ejection unit side to the identical electric potential in the identical electric potential state.

3. The liquid ejecting apparatus according to claim 1, wherein the electric potential control unit is switched from the electric potential difference generating state to the identical electric potential state before the front end of the ejecting medium enters the liquid ejecting area.

4. The liquid ejecting apparatus according to claim 1, wherein the electric potential control unit is switched from the identical electric potential state to the electric potential difference generating state after a rear end of the ejecting medium comes out of the liquid ejecting area.

5. The liquid ejecting apparatus according to claim 1, wherein the electric potential control unit is configured so as to switch between the identical electric potential state and the electric potential difference generating state in an end portion area of the ejecting medium in a second direction perpendicular to a first direction which is the transport direction of the ejecting medium, whereby in an area except for the end portion area, the electric potential difference is formed between the liquid ejection unit and the ejecting medium support unit.

6. The liquid ejecting apparatus according to claim 1, wherein the predetermined region of the liquid ejection unit side is a surface which faces the ejecting medium support unit, and wherein the predetermined region of the ejecting medium support unit side is a surface which faces the liquid ejection unit.

7. The liquid ejecting apparatus according to claim 1, wherein the area of the predetermined region of the ejecting medium support unit side, which corresponds to the ejecting medium end portion in the second direction, includes a position corresponding to at least one side end portion of the ejecting medium in the second direction, and extends further to an outer side and an inner side of the ejecting medium than the position, and wherein a line, which connects a terminal position further to the inner side than the end portion of the ejecting medium in an area corresponding to the ejecting medium end portion of the predetermined region of the ejecting medium support unit side and a terminal position of further to the outer side than the end portion of the ejecting medium in the predetermined region of the liquid ejection unit, in the side of at least one side end portion of the ejecting medium in the second direction, is configured to intersect the ejecting medium.

* * * * *